US012673234B2

(12) United States Patent
Li

(10) Patent No.: US 12,673,234 B2
(45) Date of Patent: Jul. 7, 2026

(54) PORTABLE EXERCISE APPARATUS

(71) Applicant: INVENTEC APPLIANCES CORPORATION, New Taipei City (TW)

(72) Inventor: Hsien-Chien Li, New Taipei City (TW)

(73) Assignee: INVENTEC APPLIANCES CORPORATION, New Taipei City (TW)

( * ) Notice: Subject to any disclaimer, the term of this patent is extended or adjusted under 35 U.S.C. 154(b) by 108 days.

(21) Appl. No.: 18/767,941

(22) Filed: Jul. 9, 2024

(65) Prior Publication Data

US 2025/0041658 A1 Feb. 6, 2025

(30) Foreign Application Priority Data

Aug. 1, 2023 (TW) ..... 112208080
Oct. 11, 2023 (TW) ..... 112138651

(51) Int. Cl.
*A63B 22/00* (2006.01)
*A63B 21/00* (2006.01)
*A63B 22/20* (2006.01)

(52) U.S. Cl.
CPC ..... *A63B 22/0076* (2013.01); *A63B 21/153* (2013.01); *A63B 21/154* (2013.01);
(Continued)

(58) Field of Classification Search
CPC ..... A63B 21/0058; A63B 21/0724; A63B 21/153; A63B 21/154; A63B 21/4029; A63B 21/4034; A63B 21/4035; A63B 21/4045; A63B 21/4047; A63B 22/0076; A63B 22/0087; A63B 22/203; A63B 2022/0033; A63B 2022/0035;
(Continued)

(56) References Cited

U.S. PATENT DOCUMENTS 1,715,870 A * 6/1929 Spain ..... A63B 21/0552 482/72
5,076,579 A * 12/1991 Rickey ..... A63B 23/00 482/52
(Continued)

FOREIGN PATENT DOCUMENTS

CN 2232300 Y * 8/1996
CN 109248396 A * 1/2019 ..... A63B 21/008
CN 115591179 A * 1/2023 ..... A63B 22/0076
(Continued)

*Primary Examiner* — Gary D Urbiel Goldner
(74) *Attorney, Agent, or Firm* — Li & Cai Intellectual Property Office

(57) ABSTRACT

A portable exercise apparatus includes a first main body, a second main body, a seat, a pedal and at least two resistance units. The second main body is connected to the first main body, the first main body and the second main body are foldable relative to each other so as to be in a folded mode or an expanded mode. The seat can be slidably disposed on the first main body when the first main body and the second main body are in the expanded mode and the pedal is in a slanted position. Each of the at least two resistance units has a resistance source that can provide a resistance force. When the first main body and the second main body are in the folded mode, the resistance sources of the at least two resistance units are respectively arranged in two receiving spaces.

19 Claims, 12 Drawing Sheets

(52) U.S. Cl.
CPC ..... *A63B 21/4029* (2015.10); *A63B 21/4034* (2015.10); *A63B 21/4035* (2015.10); *A63B 21/4047* (2015.10); *A63B 22/203* (2013.01); *A63B 2022/0079* (2013.01); *A63B 2210/50* (2013.01)

(58) Field of Classification Search
CPC ..... A63B 2022/0079; A63B 23/03508; A63B 23/03516; A63B 23/03525; A63B 23/0405; A63B 23/1209; A63B 69/06; A63B 2069/062; A63B 71/0036; A63B 71/0622; A63B 2071/025; A63B 2210/50; A63B 2225/09; A63B 2225/093
See application file for complete search history.

(56) References Cited

U.S. PATENT DOCUMENTS

| | | | | | |
|---|---|---|---|---|---|
| 6,042,523 | A * | 3/2000 | Graham | A63B 22/203 | 482/79 |
| 6,926,647 | B1 * | 8/2005 | Huang | A63B 21/0622 | 482/130 |
| 7,591,763 | B1 * | 9/2009 | Fucci | A63B 21/4013 | 482/52 |
| 2022/0184445 | A1 * | 6/2022 | Fortuin | A63B 24/0087 | |
| 2023/0226427 | A1 * | 7/2023 | Cohen | A63B 22/0087 | 211/85.7 |

FOREIGN PATENT DOCUMENTS

| | | | |
|---|---|---|---|
| TW | M647850 | U * | 11/2023 |
| TW | 850123 | B1 * | 7/2024 |

* cited by examiner

PORTABLE EXERCISE APPARATUS

CROSS-REFERENCE TO RELATED PATENT APPLICATION

This application claims the benefit of priorities to Taiwan Patent Applications No. 112138651, filed on Oct. 11, 2023, and No. 112208080, filed on Aug. 1, 2023. The entire content of the above identified applications is incorporated herein by reference.

FIELD OF THE DISCLOSURE

The present disclosure relates to a portable exercise apparatus, and more particularly to a multi-functional portable exercise apparatus that has a foldable function and that is easy to accommodate and transport after being folded.

BACKGROUND OF THE DISCLOSURE

A conventional training bench includes a plurality of dumbbells of various weights arranged thereon. The conventional training bench is bulky and heavy, so that the training bench is very difficult to be transported. An elastic rope is provided with the training bench and can be directly tied to four corners of the training bench. However, a force of the elastic rope cannot be controlled and cannot be freely combined for weight training exercises (e.g., with barbells), so that the elastic rope only has a single training function.

Furthermore, a rowing machine is another type of fitness equipment for full-body exercise. Users can perform arm stretching, body stretching, and leg flexion on the rowing machine. Due to a resistance source of the rowing machine being generally a water resistance or an air resistance, a size of the rowing machine is relatively large. The rowing machine having a foldable function that is currently available on the market is only provided in a few models for reducing the size thereof when being folded.

Therefore, if a user wants to use the above fitness equipment at home, it will inevitably take up a considerable amount of indoor space. Although the conventional rowing machine can be folded to be used as the training bench, the conventional rowing machine lacks accessories such as the dumbbell and the elastic rope. Accordingly, the conventional rowing machine is only used for simple body exercises and has limitations for targeted strength training.

SUMMARY OF THE DISCLOSURE

In response to the above-referenced technical inadequacies, the present disclosure provides a portable exercise apparatus that has a function of a rowing machine and that can be easily accommodated and transported after being folded.

In response to the above-referenced technical inadequacies, the present disclosure further provides a portable exercise apparatus that can be folded to perform the weight training exercise for all four limbs, thereby achieving a variety of strength training functions.

To address these challenges, the portable exercise apparatus includes a first main body, a second main body, a seat, a pedal, and at least one resistance unit. The first main body has at least one receiving space. The second main body is connected to the first main body. Both main bodies are foldable relative to each other so as to be in a folded mode or an expanded mode. The seat is slidably disposed on the first main body when expanded. The pedal is disposed between the first main body and the second main body. The pedal is in a slanted position when the first main body and the second main body are in the expanded mode. The at least one resistance unit has a resistance source and is disposed on at least one of the first main body, the second main body, and the pedal. When folded, the first main body and the second main body jointly have a box shape, so that at least one of the seat and the pedal is located between the first main body and the second main body. Additionally, the resistance source of the at least one resistance unit is arranged in the at least one receiving space and is connected to at least one pulling member.

Therefore, in the portable exercise apparatus provided by the present disclosure, the portable exercise apparatus allows a user to simulate rowing movements and has a foldable function. In addition, when the first main body and the second main body are folded to jointly have a box shape, at least one of the seat and the pedal is located between the first main body and the second main body, such that the first main body and the second main body have a flat and aesthetic appearance when folded, thereby allowing the user to easily store and transport the equipment.

Additionally, when both of the main bodies are folded, the user can utilize the resistance source and the pulling member placed within the receiving space for comprehensive weight training of all four limbs.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
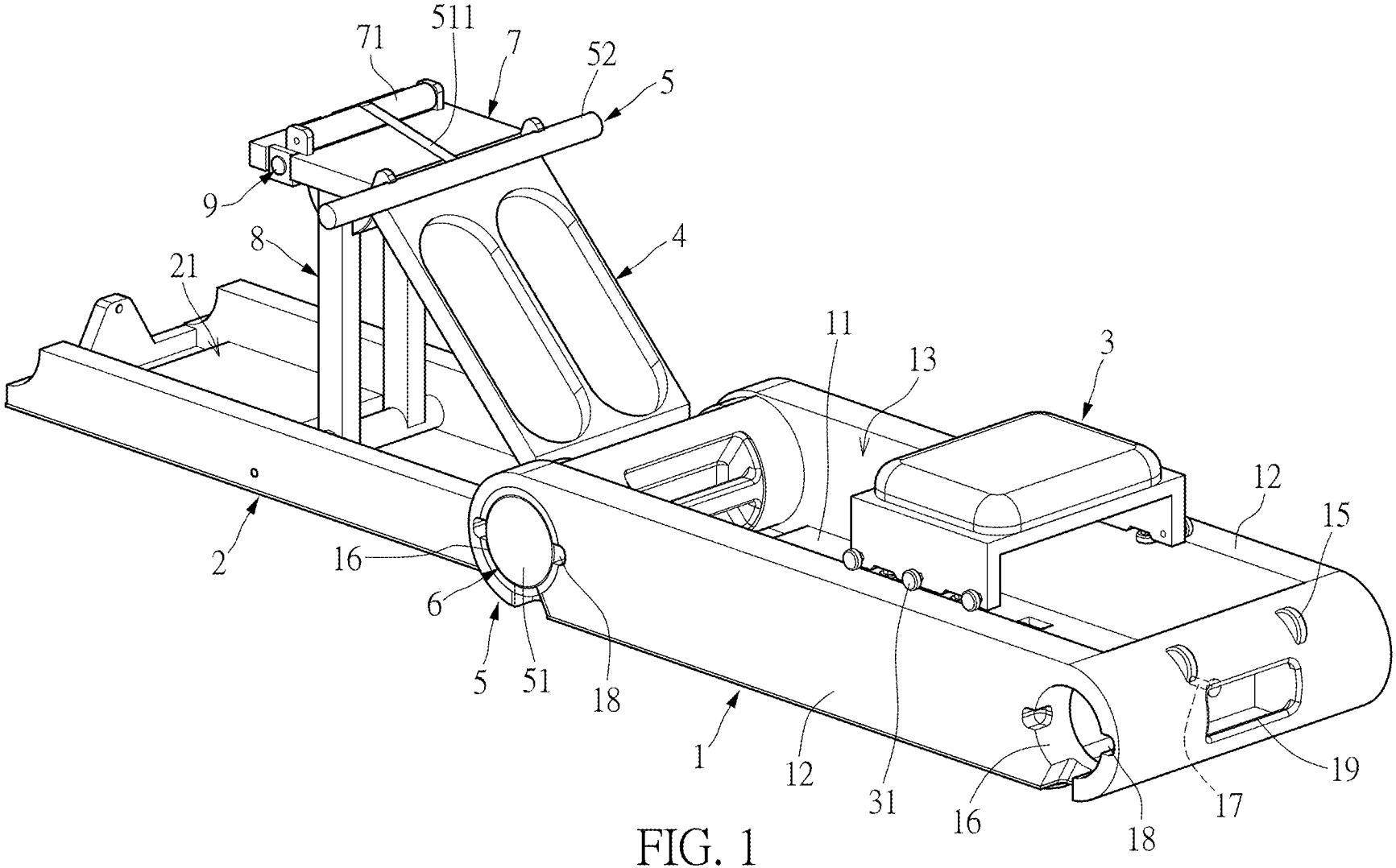
FIG. 1 is a schematic perspective view of the portable exercise apparatus in an expanded mode according to a first embodiment of the present disclosure.
Figure 4:
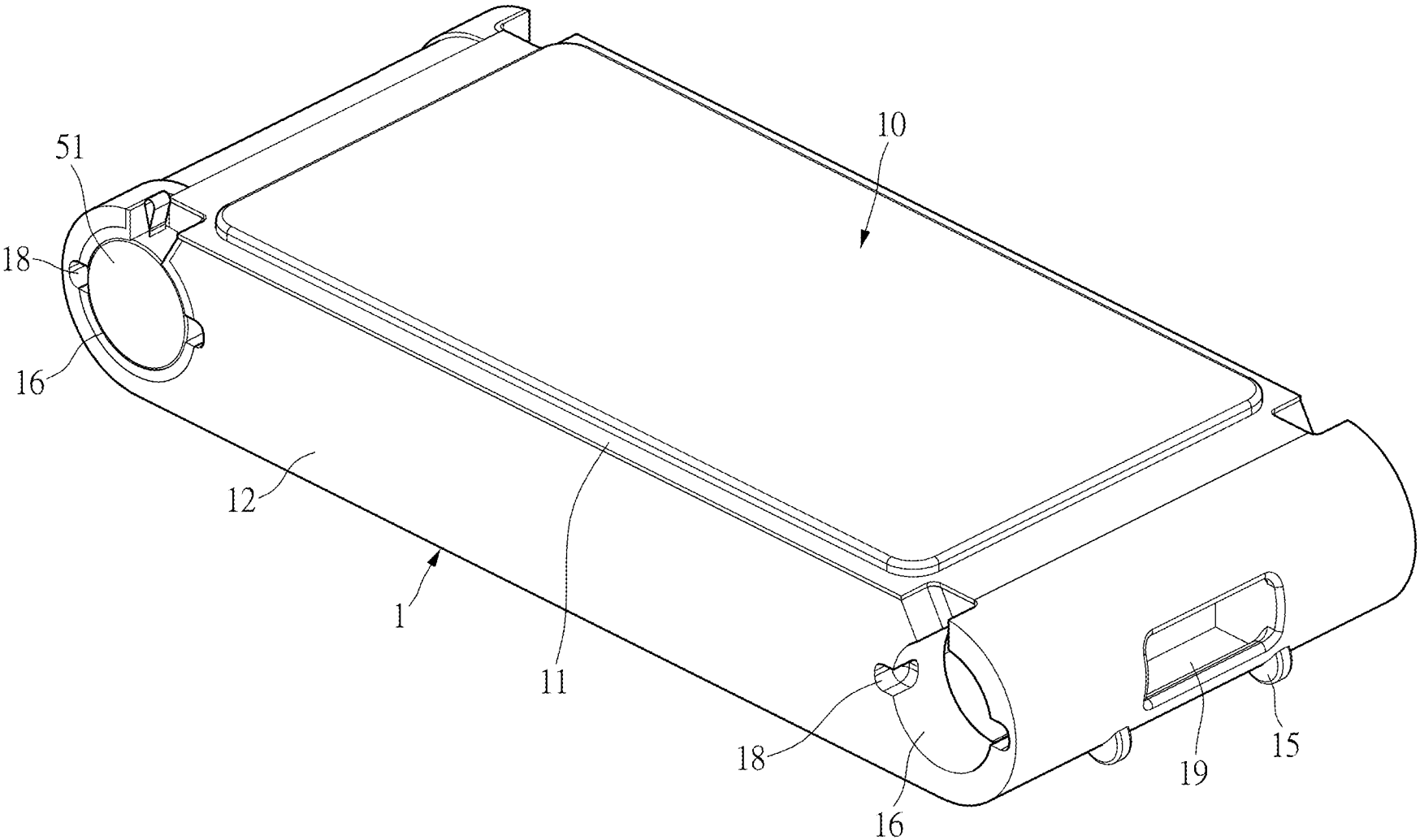
FIG. 4 is a schematic perspective view of the portable exercise apparatus in the folded mode from another angle of view according to the first embodiment of the present disclosure.

Referring to FIG. 1 and FIG. 4, the present disclosure provides a portable exercise apparatus. The portable exercise apparatus includes a first main body 1, a second main body 2, a seat 3, a pedal 4, and at least two resistance units 5.

Figure 3:
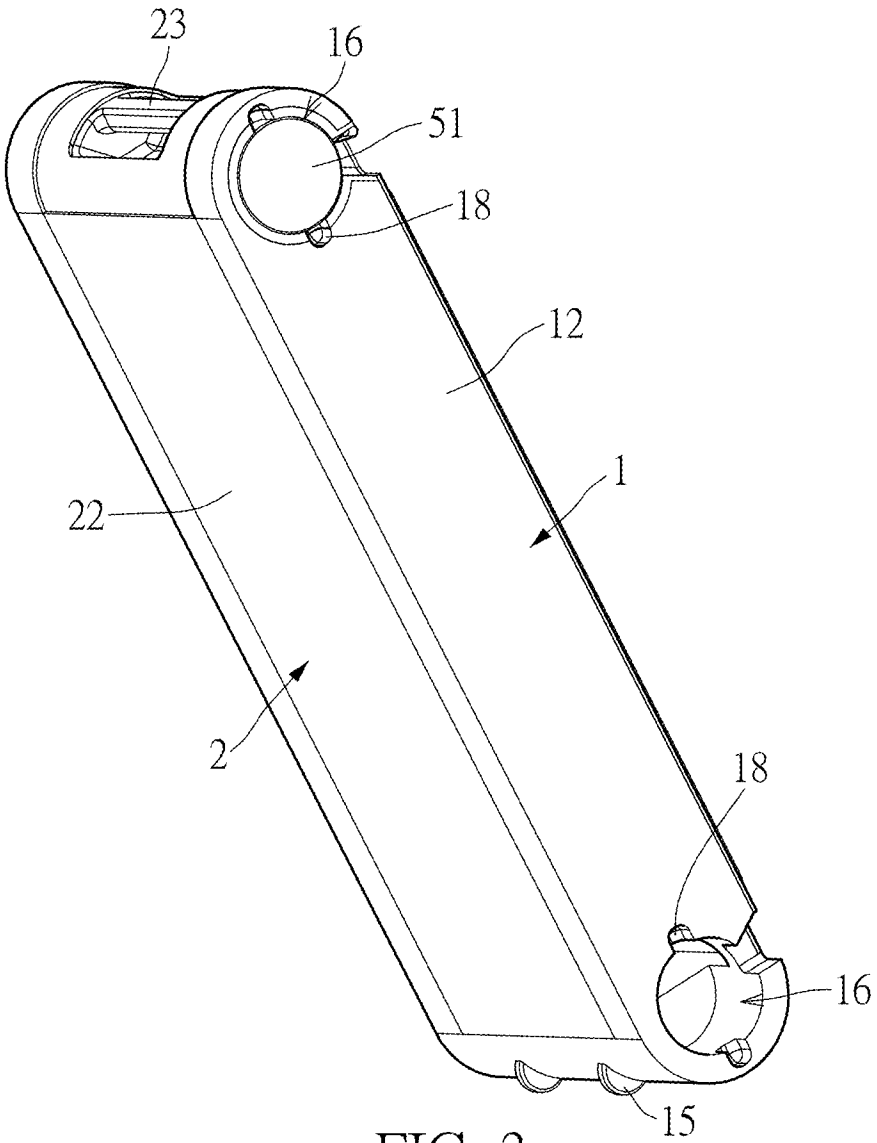
FIG. 3 is a schematic perspective view of the portable exercise apparatus in a folded mode according to the first embodiment of the present disclosure.

The first main body 1 and the second main body 2 are connected. Both of the main bodies are pivotally connected through a rotation shaft 6, and the first main body 1 and the second main body 2 are foldable relative to each other so as to be in a folded mode or an expanded mode. When the first main body 1 and second main body 2 are in the folded mode, the first main body 1 and the second main body 2 jointly have a box shape (as shown in FIG. 3 and FIG. 4) or a cube shape, so that the seat 3 and the pedal 4 are located and received between the first main body 1 and the second main body 2.

In the present embodiment, the first main body 1 has a first panel 11 and two sideboards 12 that are connected to and uprightly disposed on two opposite sides of the first panel 11, and an accommodating space 13 is formed among the first panel 11 and the two sideboards 12. When the first main body 1 and the second main body 2 are in the folded mode, the second main body 2 is accommodated in the accommodating space 13, so that the first main body 1 and the second main body 2 jointly have the box shape for reducing the size of the portable exercise apparatus, and the seat 3 and the pedal 4 are located between the first main body 1 and the second main body 2.

Figure 5:
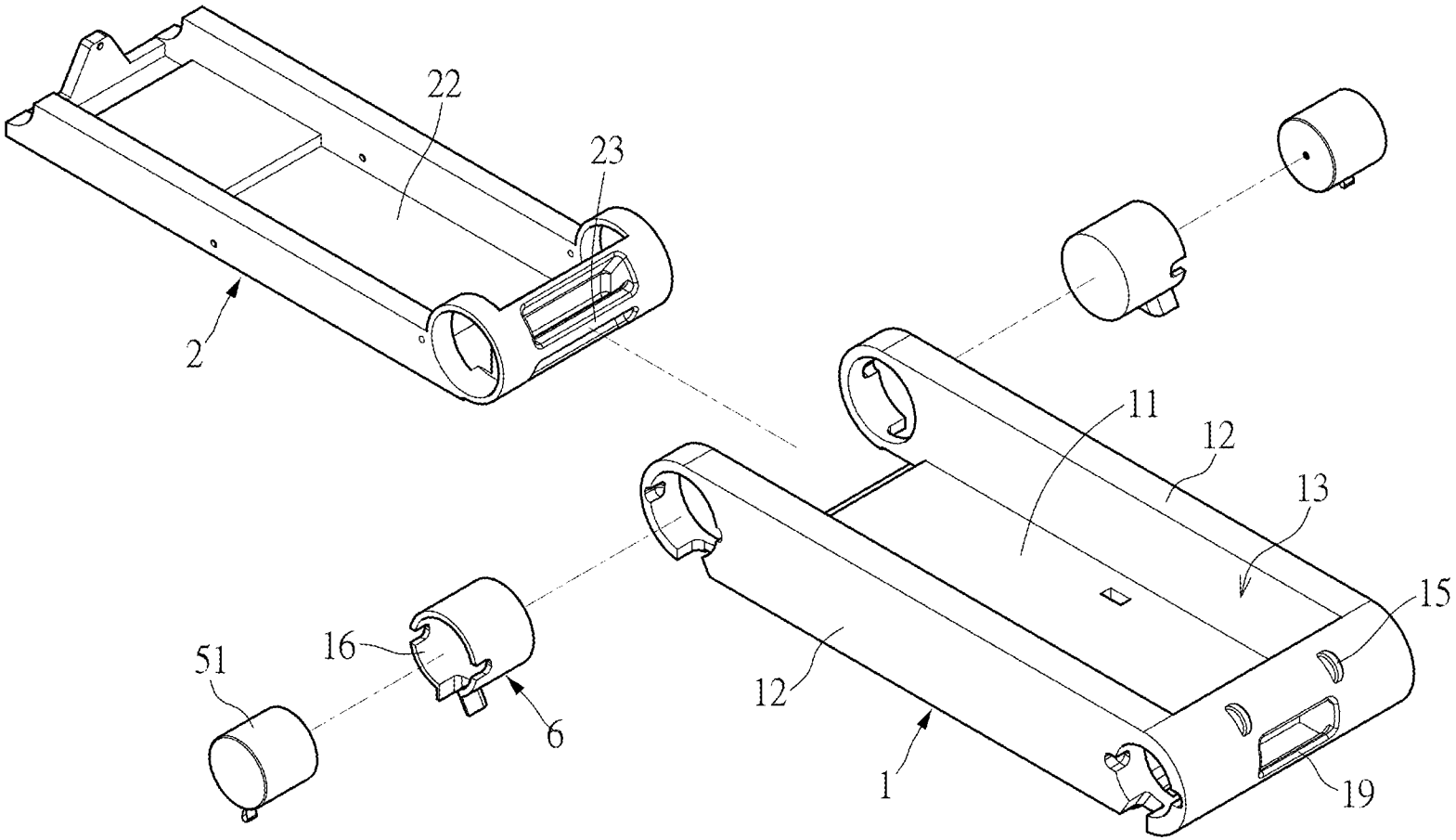
FIG. 5 is a schematic exploded view of a first main body and a second main body according to the first embodiment of the present disclosure.

The first main body 1 has at least one receiving space 16 that is exposed from the first main body 1. The receiving space 16 is preferably arranged on an edge of the first main body 1. A quantity of the receiving space 16 can be one, two, three, or four, but is not limited thereto. In the present embodiment, the quantity of the receiving space 16 is four, each of two sides of the first main body 1 has the two receiving spaces 16 that are arranged on two opposite ends thereof. Specifically, the receiving spaces 16 are respectively arranged at four corners of the first main body 1, so that there is a larger distance between the two receiving spaces 16 on a same side of the first main body 1. In the present embodiment, the rotation shaft 6 is a hollow cylinder, and the receiving space 16 can be formed in the rotation shaft 6 (as shown in FIG. 5), so that the rotation shaft 6 further has an accommodating function that can accommodate a resistance source 51.

In the present embodiment, the first main body 1 has multiple recessed spaces 18 recessed in the two sides thereof, two outer surfaces of each of the receiving spaces 16 are respectively formed with two of the recessed spaces 18, and each of the receiving spaces 16 and the corresponding two recessed spaces 18 are in spatial communication with each other, so that fingers can easily reach into the recessed spaces 18 to remove or insert the resistance source 51.

In the present embodiment, the second main body 2 has a second panel 22 (as shown in FIG. 3), and when the first main body 1 and second main body 2 are in the folded mode, the second panel 22 covers the accommodating space 13, so that the first main body 1 and the second main body 2 jointly have a complete box structure. Specifically, one end of the second main body 2 is disposed on a first handle (i.e., a handle) 23, one end of the first main body 1 is fitted with two wheels 15, which are rotatably and pivotally connected to the first main body 1. When the first main body 1 and the second main body 2 of the embodiment are not in the expanded mode, an accommodating state of the first main body 1 and the second main body 2 is an upright cube that has the first handle 23 arranged on a top thereof and the wheels 15 are arranged at the bottom thereof for being easily accommodated and transported (as shown in FIG. 3). The first handle 23 can be disposed on the one end of the first main body 1, and the two wheels 15 can be disposed on the one end of the second main body 2.

Additionally, a locking mechanism 17 can be disposed between the first main body 1 and the second main body 2 (as shown in FIG. 1), and the locking mechanism 17 can be an insertion pin, a hook, or various locking structures. This allows the first main body 1 and second main body 2 to lock together using the locking mechanism 17 when they are folded. Furthermore, a cushion 10 (as shown in FIG. 4) is attached onto an outside of the first panel 11 or the second panel 22, so that a user can be more comfortable in lying or kneeling positions when playing tension training. The one end of the first main body 1 or the second main body 2 having the two wheels 15 further has a second handle (i.e., a handle) 19 (as shown in FIG. 1) that is used for expanding or folding the portable exercise apparatus.

Figure 6:
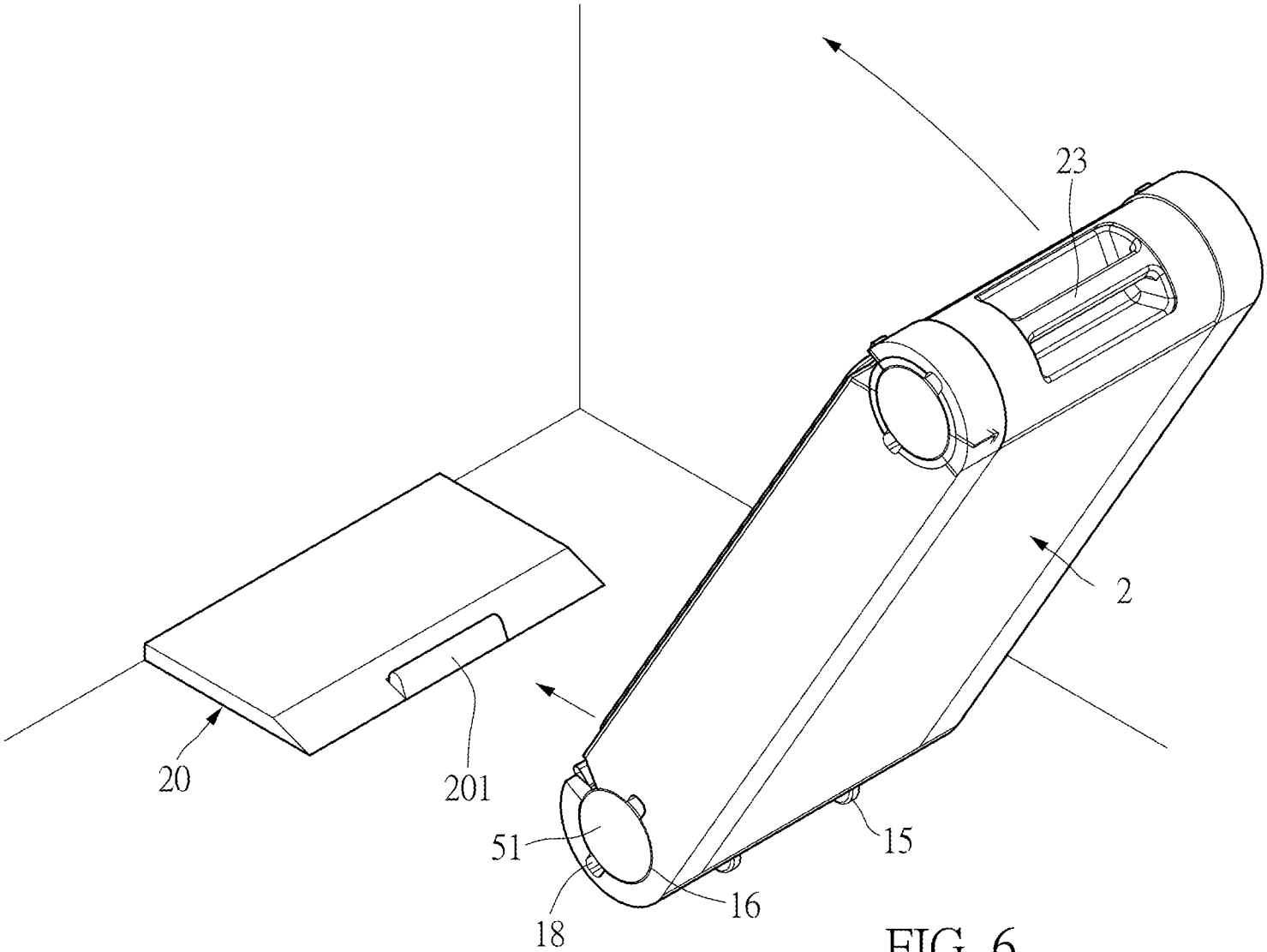
FIG. 6 is a schematic perspective view of the portable exercise apparatus uprightly disposed according to the first embodiment of the present disclosure.
Figure 7:
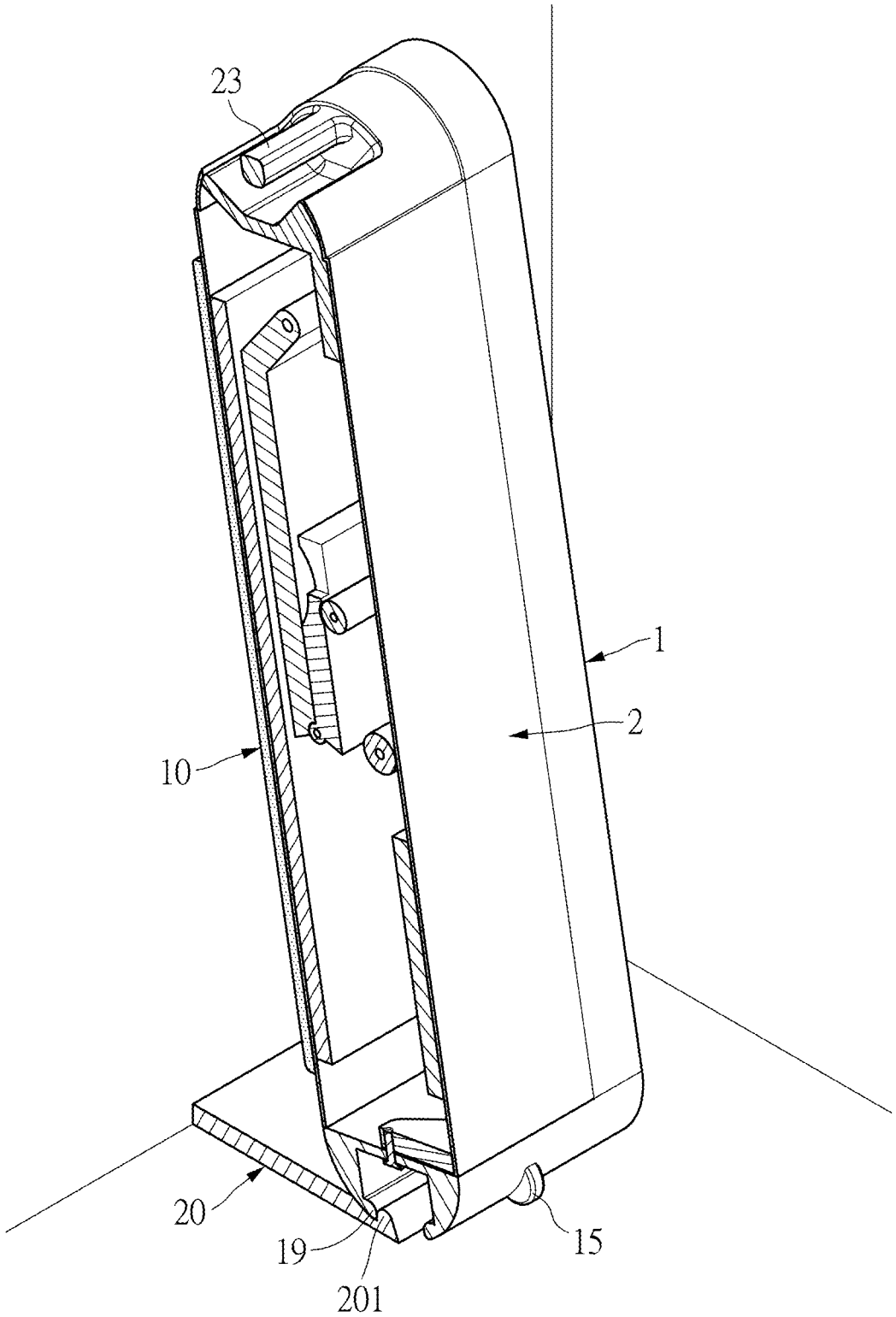
FIG. 7 is a schematic cross-sectional view of the portable exercise apparatus uprightly disposed according to the first embodiment of the present disclosure.

When the portable exercise apparatus is in the folded mode, it can be laid flat on the floor, or it can also be uprightly placed by using a top end thereof to abut against a wall and using a bottom end thereof to be cooperated with a base 20 (as shown in FIG. 6 and FIG. 7). The first main body 1 and the second main body 2 are configured to be uprightly disposed on the base 20. The base 20 has a block structure 201. The block structure 201 and the second handle 19 are engaged with each other, and a length of the block structure 201 is less than or equal to a length of the second handle 19. The portable exercise apparatus can be stably and uprightly placed and abut against the wall through the engagement between the block structure 201 and the second handle 19.

Under ordinary circumstances, the seat 3 can be accommodated in the second main body 2, and a containment space 21 (as shown in FIG. 1) can be formed in the second main body 2 for accommodating the seat 3. When the portable exercise apparatus needs to be expanded, the first main body 1 and the second main body 2 can be expanded first, the seat 3 can then be placed onto the first main body 1 by being taken out from the second main body 2, so that the first main body 1 and the second main body 2 are in the expanded mode, and a bottom of the seat 3 has a plurality of rollers 31 that can roll independently or that can be provided in multiple pairs each assembled to left and right ends of one connecting rod, the rollers 31 being slidable on the two sideboards 12 of the first main body 1. Due to a sliding technology being a conventional technology, a sliding structure of the present disclosure does not have limitations, and the embodiment is not described for brevity's sake.

Figure 2:
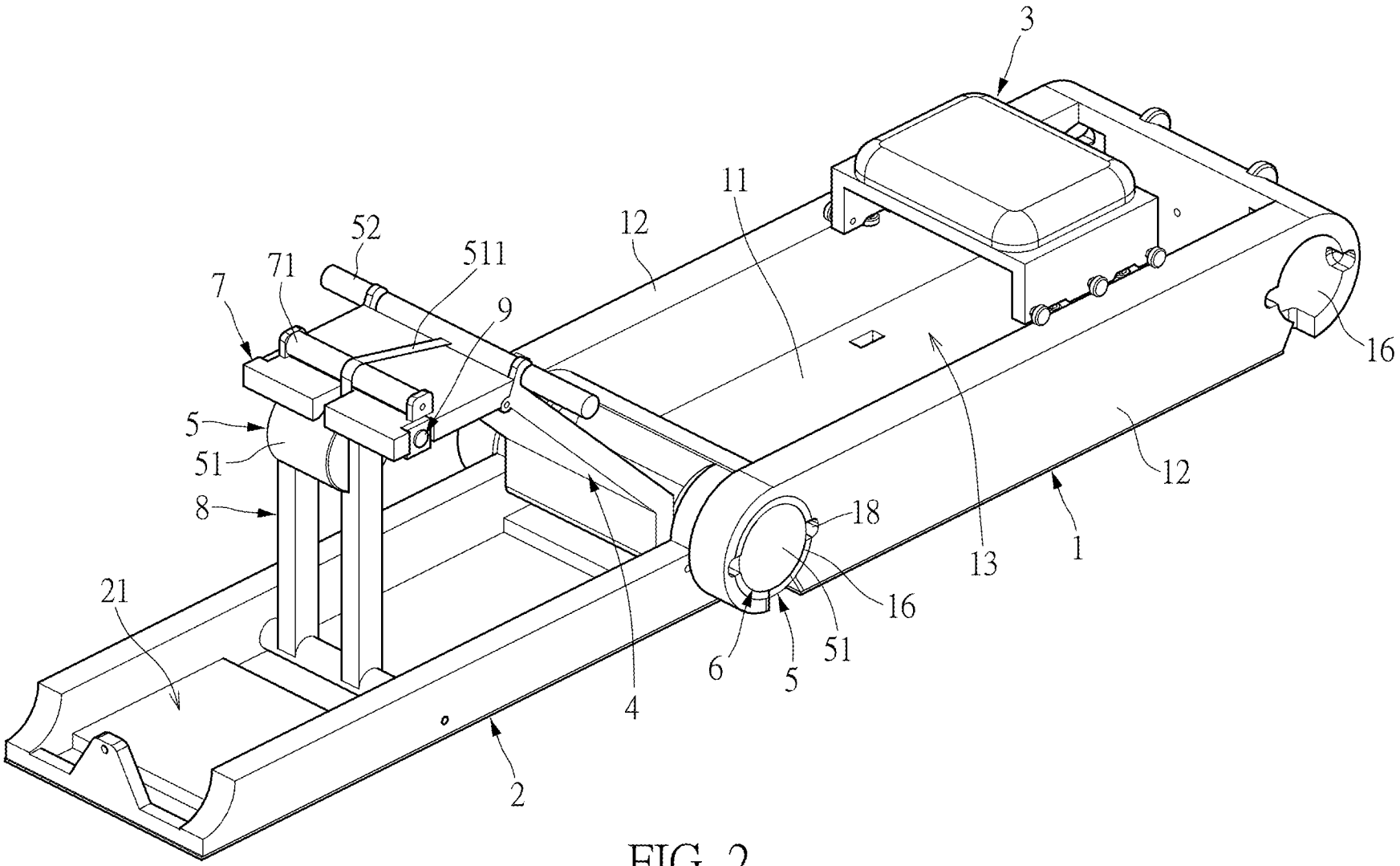
FIG. 2 is a schematic perspective view of the portable exercise apparatus in the expanded mode from another angle of view according to the first embodiment of the present disclosure.

The pedal 4 is disposed between the first main body 1 and the second main body 2. When the first main body 1 and the second main body 2 are in the expanded mode, the pedal 4 can be rotated to a slanting position in a use state (as shown in FIG. 1 and FIG. 2), so that the user's feet can be placed on and supported by the pedal 4 during training.

The two resistance units 5 are disposed on at least one of the first main body 1, the second main body 2, and the pedal 4. Each of the two resistance units 5 has a resistance source 51, at least one pull rope 511, and other components. The resistance source 51 can be a tension motor or other components for providing a resistance force. When the first main body 1 and second main body 2 are in the folded mode, the resistance sources 51 of the two resistance units 5 are respectively accommodated in the two receiving spaces 16. When the portable exercise apparatus needs to utilize the function of rowing machine, one of the resistance sources 51 can be taken out from the corresponding receiving space 16 for transforming into the rowing machine structure. The resistance sources 51 can be combined with at least one pulling member 52 that includes a pull-up bar, an exercise bar, and fitness rings, etc., but the present disclosure is not limited thereto.

One end of the pedal 4 is pivotally connected to the second main body 2, and the pedal 4 is rotatable relative to the second main body 2. Another end of the pedal 4 is pivotally connected to a pulley plate 7. A pulley 71 is rotatably disposed on the pulley plate 7, and the pulley plate 7 is rotatable relative to the pedal 4, so that the pedal 4 and the pulley plate 7 can be stacked on an inside of the second main body 2 or can be rotated and expanded according to the requirements. The second main body 2 is pivotally connected to a supporting frame 8. The pedal 4, the pulley plate 7, and the supporting frame 8 can be rotated and expanded for enabling the supporting frame 8 to support the pulley plate 7 and the pedal 4 and enabling the resistance source 51 to be disposed on the supporting frame 8 (as shown in FIG. 2). Furthermore, the pulley plate 7 can also press the resistance source 51, and the supporting frame 8 and the pulley plate 7 are fixed through at least one insertion pin 9 inserted therein, so that the pedal 4, the pulley plate 7, and the supporting frame 8 can be fixed. The pull rope 511 of the resistance source 51 can be smoothly pulled through the pulley 71, such that after the pull rope 511 is pulled out and crosses the pulley 71, a moving direction of the pull rope 511 is changed, thereby completing the assembly of the rowing machine (as shown in FIG. 1 and FIG. 2) for enabling an operation of the rowing machine to begin.

Figure 8:
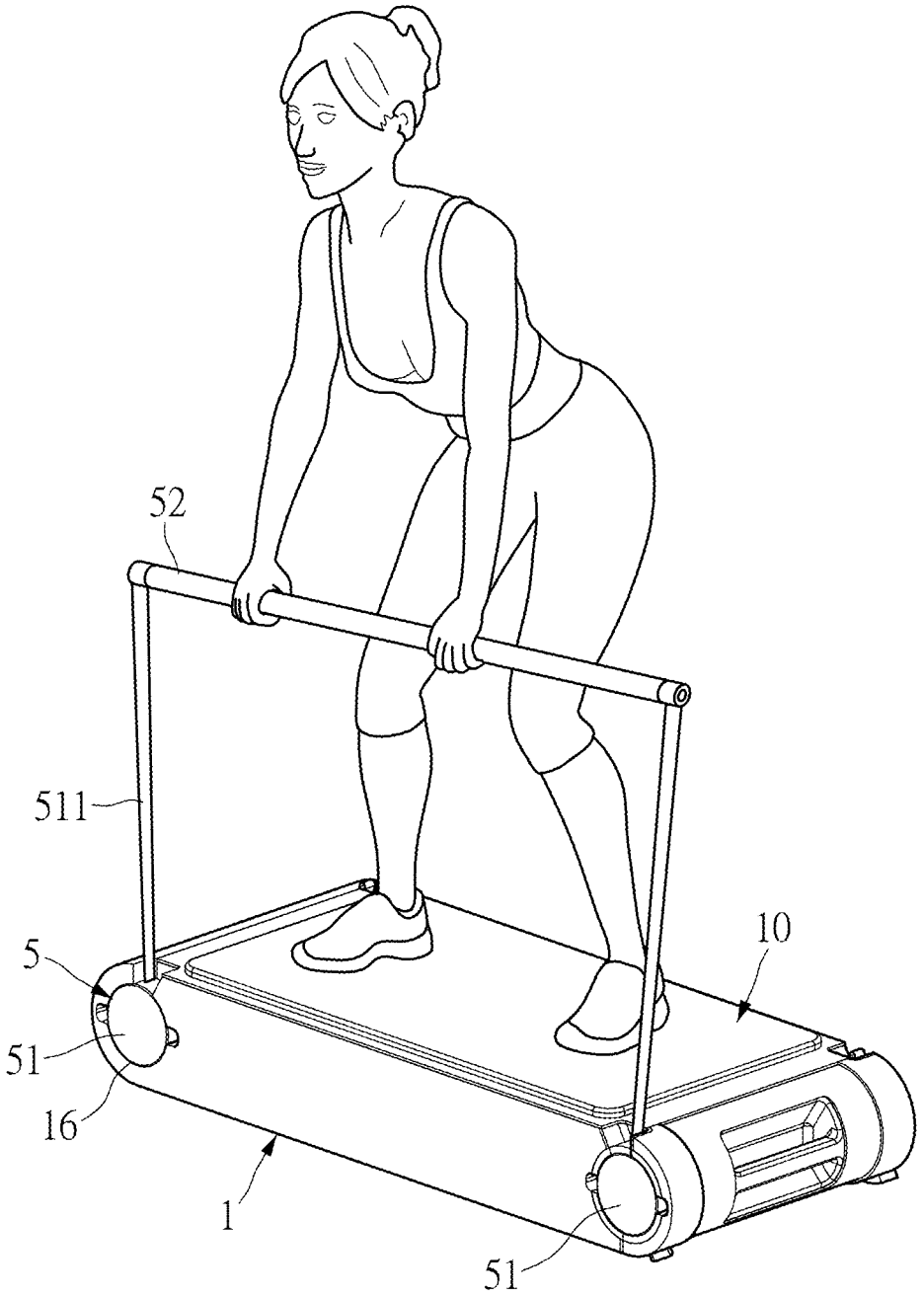
FIG. 8 is a schematic view showing the portable exercise apparatus in a usage mode for weight training according to the first embodiment of the present disclosure.
Figure 9:
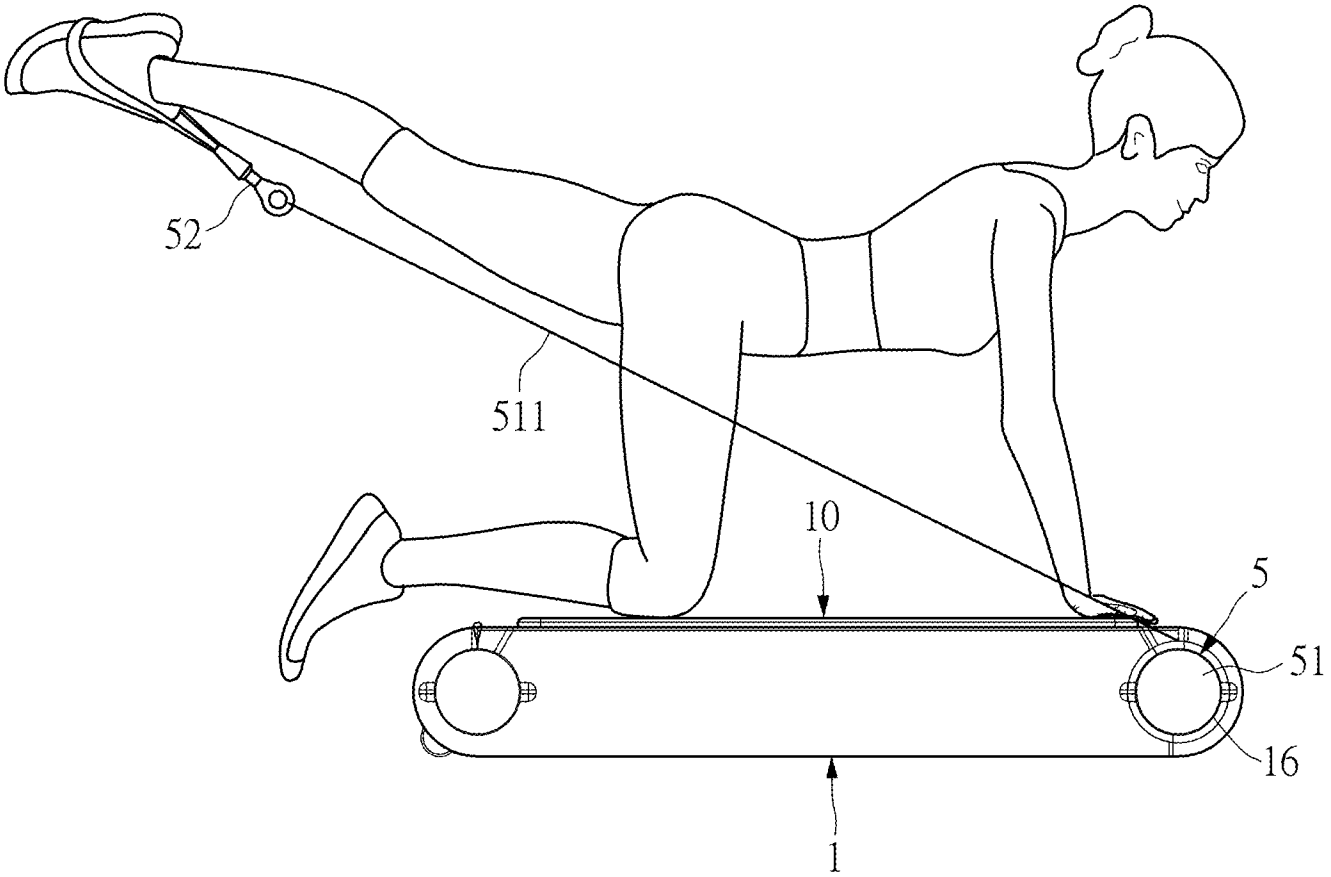
FIG. 9 is a schematic view showing the portable exercise apparatus in another usage mode for weight training according to the first embodiment of the present disclosure.

As shown in FIG. 8 and FIG. 9, when the first main body 1 and the second main body 2 are in the folded mode (i.e., an accommodating mode), the user can utilize the resistance source 51 and the pulling member 52 placed in the receiving space 16 to play tension and weight training for all four limbs.

When the two resistance units 5 are in use, the two resistance units 5 can be operated synchronously and can perform resistance compensation. Under many circumstances, the user may simultaneously use the resistance units 5. For example, when the resistance units 5 are operated in a simulated barbell mode, they need to provide the resistance force at the left and right sides of the user. If the two resistance units 5 are not synchronized, the user may feel that force from the left and right sides is unbalanced. In the present embodiment, a synchronous network including the resistance source 51 of the resistance units 51 and the pulling member 52 can be established so as to enable the resistance units 5 to be operated synchronously. When the pulling member 52 (e.g., the exercise bar, the pull-up bar, and the fitness rings) detects the imbalance of the resistance units 51, the pulling member 52 can actively compensate for the output of the resistance units 51, thereby reducing the sensation of force unbalance.

Figure 10:
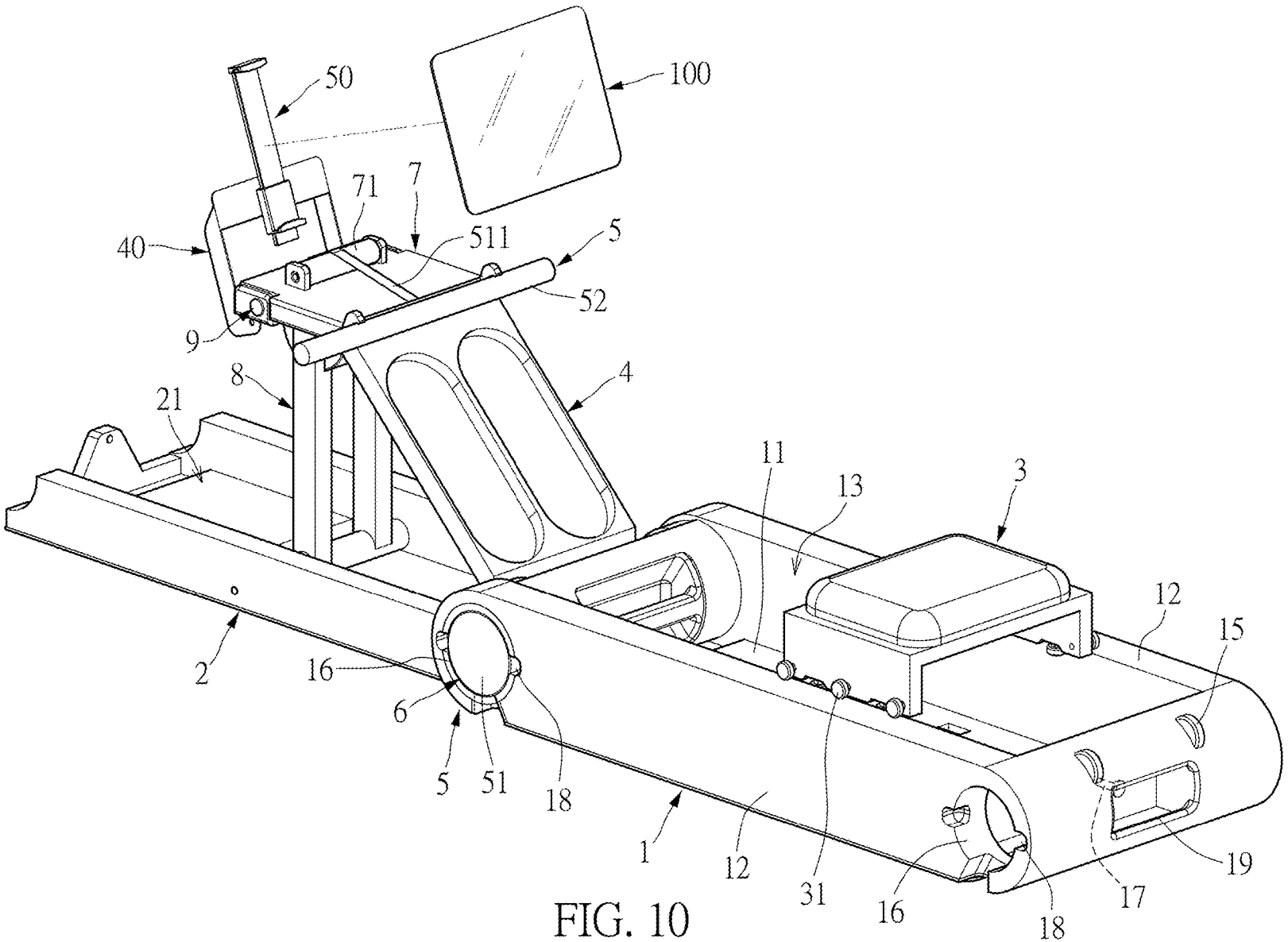
FIG. 10 is a schematic perspective view of the portable exercise apparatus in the expanded mode according to a third embodiment of the present disclosure.

As shown in FIG. 10 the fixing frame 40 can be pivotally connected to the pulley plate 7 or the supporting frame 8 of the present disclosure. The fixing frame 40 is rotatable relative to the pulley plate 7 or the supporting frame 8, and a telescopic frame 50 is disposed on the fixing frame 40. When the fixing frame 40 is rotated upward to a predetermined position, the fixing frame 40 is configured to hold an electronic device 100 such as a smartphone or a tablet. When the fixing frame 40 is rotated upward to a predetermined position, the telescopic frame 50 can be used to clamp and fix the electronic device 100 such as a smartphone or a tablet. The electronic device 100 can display information or a course of the user exercise in a wireless communication manner or other manners.

Figure 11:
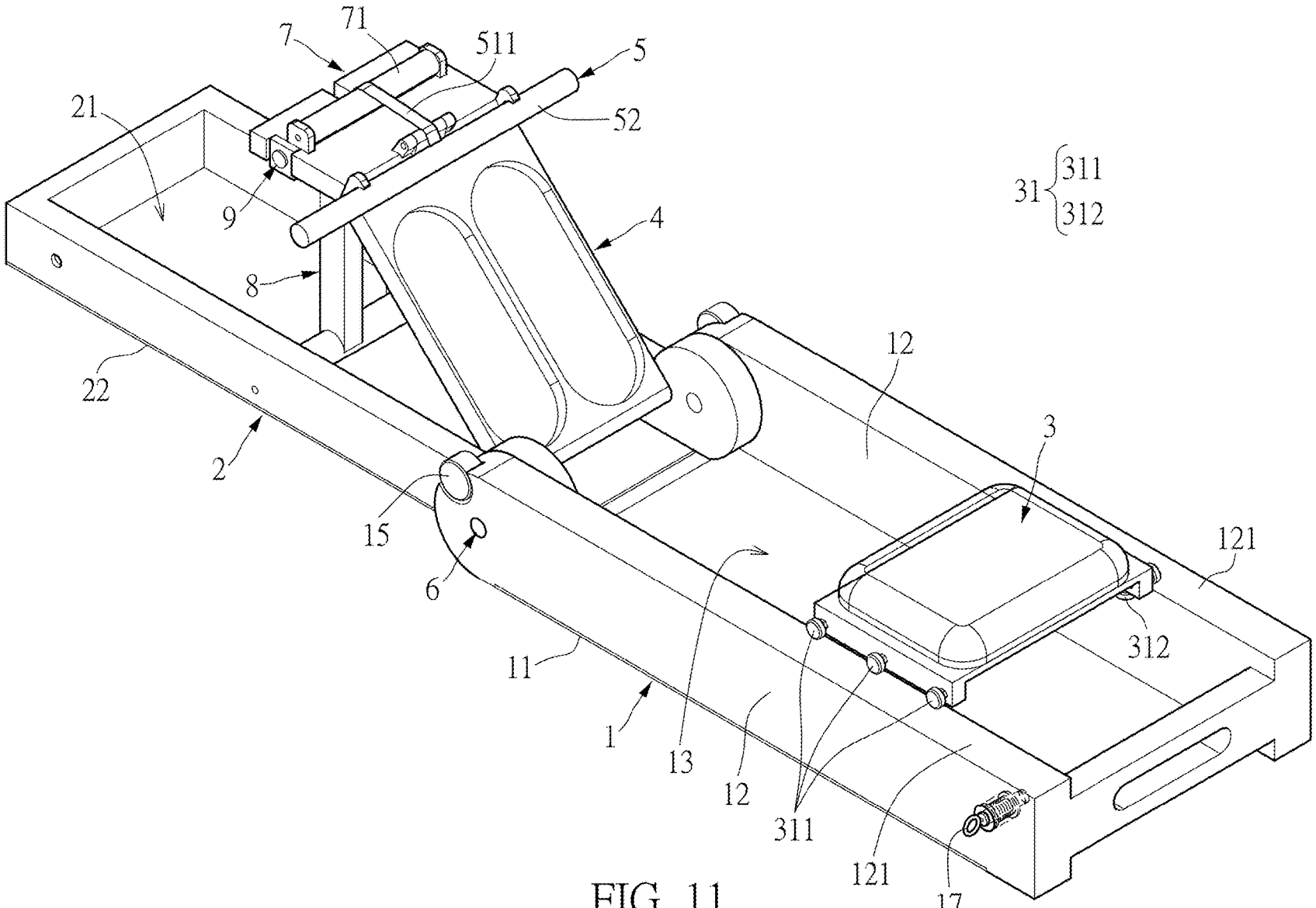
FIG. 11 is a schematic perspective view of the portable exercise apparatus in the expanded mode according to a fourth embodiment of the present disclosure.
Figure 12:
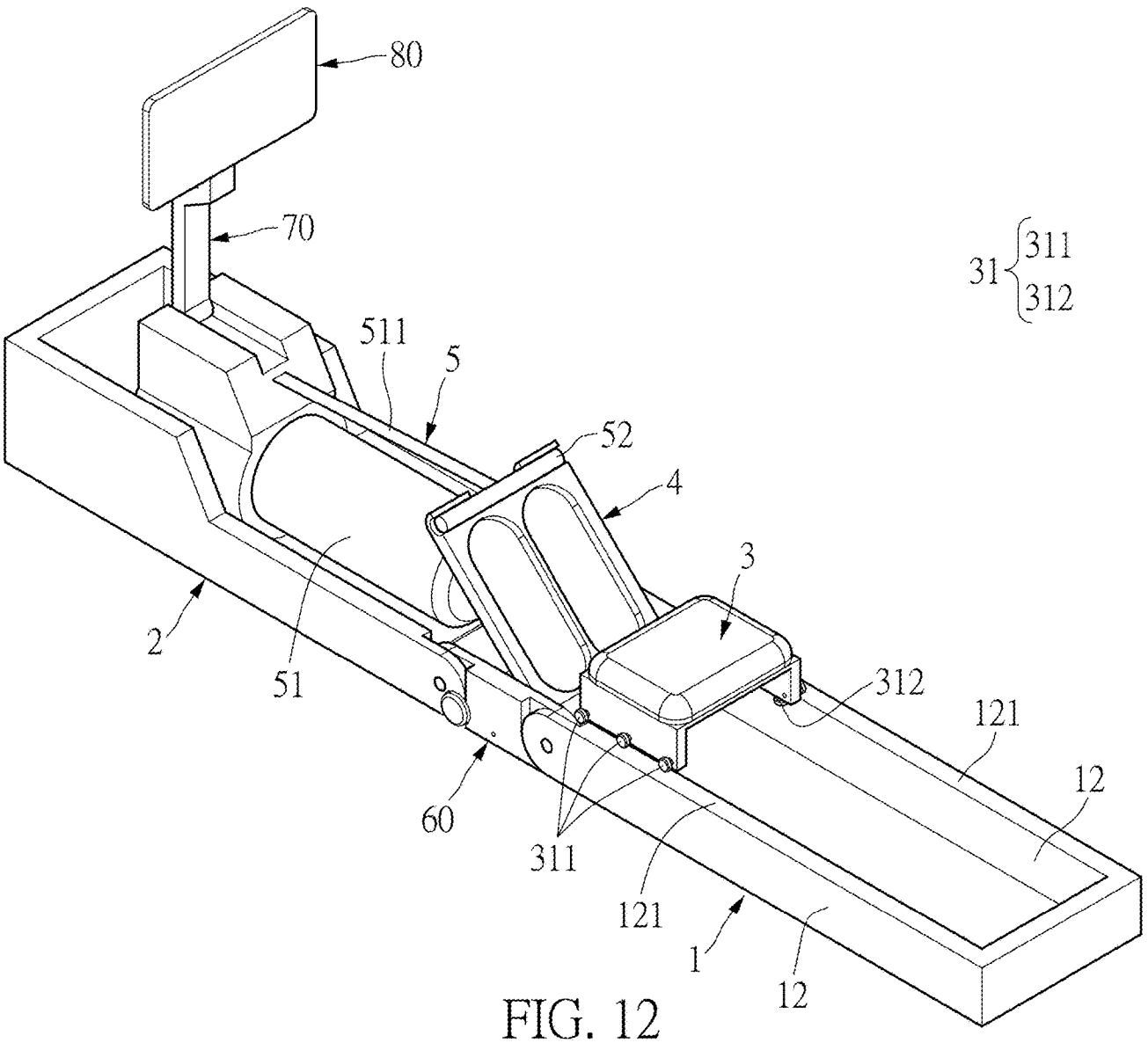
FIG. 12 is a schematic perspective view of the portable exercise apparatus in the expanded mode according to a fifth embodiment of the present disclosure.

Referring to FIG. 11, the present disclosure provides the portable exercise apparatus which includes the first main body 1, the second main body 2, the seat 3, the pedal 4, and at least one resistance unit 5. The present embodiment is substantially similar to the previously mentioned first embodiment, with the following differences: the first main body 1 of the present embodiment is provided without the receiving space 16. The first main body 1 and the second main body 2 are pivotally connected to each other through at least one rotation shaft 6, so that the first main body 1 and the second main body 2 are foldable relative to each other so as to be in the folded mode or the expanded mode (as shown in FIG. 12). When the first main body 1 and the second main body 2 are in the expanded mode, the seat 3 is slidably disposed on the first main body 1. When the first main body 1 and the second main body 2 are in the folded mode, the first main body 1 and the second main body 2 jointly have the box shape, so that at least one of the seat 3, the pedal 4, and the resistance unit 5 is located between the first main body 1 and the second main body 2. The portable exercise apparatus has a flat and aesthetic appearance when folded, thereby allowing the user to easily accommodate and transport the equipment. When the first main body 1 and the second main body 2 are in the expanded mode, the portable exercise apparatus can be used as the rowing machine.

In the present embodiment, each of two sides of the first main body 1 has a slide rail 121 that extends along a longitudinal direction of the first main body 1, and the slide rails 121 are formed on the sideboards 12 of the first main body 1. The rollers 31 include a plurality of horizontal rollers 311 and a plurality of vertical rollers 312. The horizontal rollers 311 are respectively arranged on two sides of the seat 3 and are slidably contacted with the two slide rails 121, respectively, so that the seat 3 can smoothly slide. The vertical rollers 312 are arranged on a bottom side of the seat 3 and are slidably contacted with a side of the two slide rails 121 for limiting a linear movement of the seat 3, so that the seat 3 cannot deviate and swing when being moved, and the seat 3 can slide more smoothly. The sliding structure of the seat 3 disposed on the first main body 1 is not limited by the present embodiment. For example, the horizontal rollers 311 and the vertical rollers 312 can be replaced by a plurality of sliding blocks (not shown), and the slide rails 121 can be replaced by a plurality of linear bearings (not shown). Due to a sliding technology being a conventional technology, the sliding structure is not limited by the present disclosure.

Referring to FIG. 12, the present disclosure provides the portable exercise apparatus which includes the first main body 1, the second main body 2, the seat 3, the pedal 4, and the at least one resistance unit 5. The present embodiment is substantially similar to the previously mentioned first embodiment, with the following differences: the first main body 1 of the present embodiment is provided without the receiving space 16. The first main body 1 and the second main body 2 are hollow shells that combine to form a box, and they are connected to each other through a connection member 60. That is to say, the one end of the first main body 1 and the one end of the second main body 2 are pivotally connected to the connection member 60, so that the first main body 1 and the second main body 2 are rotatable relative to the connection member 60 and are foldable relative to each other for being in the folded mode or the expanded mode (as shown in FIG. 12).

The resistance source 51 of the present embodiment is a torpedo water resistance. In the present embodiment, the resistance source 51 can be disposed on the second main body 2. A screen bracket 70 is disposed on the second main body 2, and a screen 80 is disposed on the screen bracket 70. The screen 80 can be fixed on the screen bracket 70 through various manners such as bracket clamps, magnetic suction, screw locking, or adhesive, etc., and an installation manner of the screen 80 is not limited thereto. The screen bracket 70 is foldably disposed on the second main body 2, and the screen 80 is rotatably disposed on the screen bracket 70. When the user wants to use the screen 80, the user can rotate the screen bracket 70 and the screen 80 by 90 degrees to arrive at a use position (as shown in FIG. 12). Accordingly, the screen 80 can display the information or the course of the user exercise through a wireless communication manner or other means. When the portable exercise apparatus is in the folded mode, the user can reverse the above operation to fold and move the portable exercise apparatus easily.

BENEFICIAL EFFECTS OF THE EMBODIMENTS

In conclusion, the present disclosure provides the portable exercise apparatus which includes the first main body 1, the second main body 2, the seat 3, the pedal 4, and the at least one resistance unit 5. The first main body 1 has at least one receiving space 16, the second main body 2 is connected to the first main body 1, and the first main body 1 and the second main body 2 are foldable relative to each other so as to be in the folded mode or the expanded mode. Moreover, when the first main body 1 and the second main body 2 are in the expanded mode, the seat 3 is slidably disposed on the first main body 1, and the pedal 4 is in the slanted position. The at least one resistance unit 5 has the resistance source 51 that can provide the resistance force. When the first main body 1 and the second main body 2 are in the folded mode, the first main body 1 and the second main body 2 jointly have the box shape, so that the at least one of the seat 3 and the pedal 4 is located between the first main body 1 and the second main body 2. Furthermore, when the first main body 1 and the second main body 2 are in the folded mode, the resistance source 51 of the at least one resistance unit 5 is arranged in the at least one receiving space 16 and is connected to at least one pulling member 52. The portable exercise apparatus of the present disclosure can allow the user to simulate a rowing movement and has the foldable function. The first main body 1 and the second main body 2 jointly have the box shape, so that at least one of the seat 3 and the pedal 4 is located between the first main body 1 and the second main body 2. Accordingly, the first main body 1 and the second main body 2 have the flat and aesthetic appearance when folded, thereby allowing the user to easily store and transport the equipment. When the first main body 1 and the second main body 2 are folded to be in the folded mode, the user can utilize the resistance source 51 and the pulling member 52 placed within the receiving space 16 to play the weight training for all four limbs, so as to achieve a variety of strength training functions.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A portable exercise apparatus, comprising:

a first main body having at least one receiving space;

a second main body connected to the first main body, wherein the first main body and the second main body are foldable relative to each other so as to be in a folded mode or an expanded mode;

a seat that is slidably disposed on the first main body when the first main body and the second main body are in the expanded mode;

a pedal disposed between the first main body and the second main body, wherein the pedal is in a slanted position when the first main body and the second main body are in the expanded mode; and at least one resistance unit having a resistance source and being disposed on at least one of the first main body, the second main body, or the pedal;

wherein, when the first main body and the second main body are in the folded mode, the first main body and the second main body jointly have a box shape, so that at least one of the seat and the pedal is located between the first main body and the second main body; and wherein, when the first main body and the second main body are in the folded mode, the resistance source of the at least one resistance unit is arranged in the at least one receiving space and is connected to at least one pulling member.

2. The portable exercise apparatus according to claim 1, further comprising:

a pulley plate pivotally connected to the pedal; and a fixing frame pivotally connected to one end of the pulley plate and configured to rotate upward to a predetermined position.

3. The portable exercise apparatus according to claim 1, further comprising:

a pulley plate pivotally connected to the pedal;

a supporting frame pivotally connected to one end of the pulley plate; and a fixing frame pivotally connected to the supporting frame and configured to rotate upward to a predetermined position.

4. The portable exercise apparatus according to claim 1, wherein the first main body or the second main body has a first handle arranged on one end thereof and two wheels that are disposed on another end thereof opposite to the first handle.

5. The portable exercise apparatus according to claim 1, wherein, when the first main body and the second main body are in the folded mode, the first main body and the second main body are configured to be uprightly disposed on a base.

6. The portable exercise apparatus according to claim 5, wherein the first main body or the second main body further has a second handle, the base has a block structure, and the block structure and the second handle are engaged with each other.

7. The portable exercise apparatus according to claim 1, wherein the at least one receiving space is exposed from the first main body.

8. The portable exercise apparatus according to claim 7, wherein the first main body has two recessed spaces respectively formed on two outer surfaces of the at least one receiving space, and the two recessed spaces and the at least one receiving space are in spatial communication with each other.

9. The portable exercise apparatus according to claim 7, wherein the first main body and the second main body are connected to each other through at least one rotation shaft, and wherein the at least one rotation shaft is a hollow cylinder, and the at least one receiving space is formed within the at least one rotation shaft.

10. The portable exercise apparatus according to claim 1, wherein the at least one resistance unit includes a pull rope that is connected to the resistance source.

11. The portable exercise apparatus according to claim 10, wherein one end of the pedal is pivotally connected to the second main body, another end of the pedal is pivotally connected to a pulley plate, wherein a pulley is disposed on the pulley plate, the second main body is pivotally connected to a supporting frame, and wherein the pedal, the pulley plate, and the supporting frame are configured to flip and expand for enabling the supporting frame to support the pulley plate and the pedal and enabling the resistance source to be disposed on the supporting frame, such that after the pull rope is pulled out and crosses the pulley, a moving direction of the pull rope is changed.

12. The portable exercise apparatus according to claim 1, wherein the resistance source is a tension motor or a torpedo water resistance.

13. The portable exercise apparatus according to claim 1, wherein each of two sides of the first main body has a slide rail that extends along a longitudinal direction of the first main body, and the seat includes a plurality of horizontal rollers that are respectively arranged on two sides thereof and that slidably contact the two slide rails, respectively.

14. The portable exercise apparatus according to claim 13, wherein the seat includes a plurality of vertical rollers that are arranged on a bottom side thereof and that slidably contact a side of the two slide rails.

15. The portable exercise apparatus according to claim 1, wherein a screen bracket is foldably disposed on the second main body, and a screen is rotatably disposed on the screen bracket.

16. The portable exercise apparatus according to claim 1, wherein the first main body has a first panel and two sideboards that are connected to and uprightly disposed on two opposite sides of the first panel, and an accommodating space is formed among the first panel and the two sideboards, and wherein, when the first main body and the second main body are in the folded mode, the second main body is accommodated in the accommodating space.

17. The portable exercise apparatus according to claim 16, wherein the second main body has a second panel, and wherein, when the first main body and second main body are in the folded mode, the second panel covers the accommodating space.

18. The portable exercise apparatus according to claim 1, wherein the first main body and the second main body are hollow shells, and the first main body and the second main body are jointly formed as a box structure.

19. The portable exercise apparatus according to claim 1, wherein a locking mechanism is disposed between the first main body and the second main body, and wherein, when the first main body and second main body are in the folded mode, the first main body and second main body are locked with each other through the locking mechanism.

* * * * *